United States Patent [19]

Mendenhall

[11] 3,999,743

[45] Dec. 28, 1976

[54] ASPHALT-AGGREGATE RECYCLE PROCESS AND APPARATUS

[76] Inventor: Robert L. Mendenhall, 1770 Industrial Road, Las Vegas, Nev. 89102

[22] Filed: Aug. 11, 1975

[21] Appl. No.: 603,357

[52] U.S. Cl. ..... 259/158; 208/39; 259/148; 259/149

[51] Int. Cl.[2] ..... B28C 5/46; C10C 3/00; B28C 7/10

[58] Field of Search ..... 259/146, 148, 149, 154, 259/156, 157, 158, DIG. 18; 208/39

[56] References Cited

UNITED STATES PATENTS

| | | | |
|---|---|---|---|
| 1,836,261 | 12/1931 | Madsen | 259/149 |
| 3,547,411 | 12/1970 | Sowell | 259/148 |
| 3,614,071 | 10/1971 | Brock | 259/158 |
| 3,832,201 | 8/1974 | Shearer | 259/158 |

*Primary Examiner*—Richard E. Aegerter
*Assistant Examiner*—Richard R. Stearns
*Attorney, Agent, or Firm*—Jerry R. Seiler

[57] ABSTRACT

In a process for recycling used asphalt-aggregate compositions in a conventional type dryer-mixer drum in which the composition is exposed directly to flame and hot gases of combustion while it cascades along the rotating drum, and in which the flame and hot gases of combustion are directed into an input end of the drum, the improvement comprises separating crushed compositon into a plurality of different portions or increments, each comprising different particle size ranges between coarse and fine particles, introducing the coarse particles into the drum and directly exposing the particles to the flame and/or hot gases of combustion at the input end, and introducing the finer particles downstream from the input end and away from direct exposure to the flame and extremely hot gases in a temperature zone which will avoid overheating and possible burning or coking of the fine particles. The improved apparatus includes means for introducing the coarse particles at the input drum end for direct exposure to the flame or hottest gases and means for introducing the fine particles in a cooler zone of the apparatus.

In another embodiment, a burner and combustion chamber incorporating a flame barrier and heat diffuser are utilized to avoid exposing composition to flame and achieve more uniform heating.

15 Claims, 5 Drawing Figures

ASPHALT-AGGREGATE RECYCLE PROCESS AND APPARATUS

BACKGROUND OF THE INVENTION

Previous attempts to recycle used asphalt-aggregate compositions in conventional dryer drums have been generally unsuccessful. Recycling of used materials of this type are most desirable since the basic raw materials, asphalt and aggregate, are available in significant quantities in older roads and other "black top" surfaces that have settled, cracked and otherwise deteriorated because of long exposure to weather, heat extremes and weight loads. Gradual heating and mixing of the used materials and addition of certain compositions, especially make-up asphalt, in order to achieve proper or desirable asphalt-aggregate ratios and penetration characteristics, are required in the recycling process. Attempts to accomplish this in the conventional rotatable dryer drums in which hot flame is introduced are not successful because a portion of the particles high in asphalt content which are directly exposed to the flame and the extremely hot gases in the hottest portion of the drum are overheated thus becoming burned and coked. This not only undesirably degrades the asphalt, thereby substantially affecting the resulting product, but also causes smoke and other noxious fumes and volatiles to be driven directly into the atmosphere. The result is an inferior product and is undesirable from an air pollution standpoint. It is to the elimination of these problems that the present invention is directed.

SUMMARY OF THE INVENTION

The present invention provides a method of introducing used asphalt-aggregate particles in a recycling process using modified conventional dryer drums without degradation of the product and minimizing air pollution. Accordingly, it is an object to provide a method for producing recycled asphalt-aggregate compositions which are not decomposed or degraded by heating of the materials required in the process. In addition, a further modification provides a method for introducing flame and hot gases of combustion which further eliminates overheating the asphalt-aggregate particles. Another object is to provide a modified conventional dryer drum to accomplish the recycling process. These as well as other objects will be evident from the following description.

DETAILED DESCRIPTION OF THE INVENTION

Figure 1:
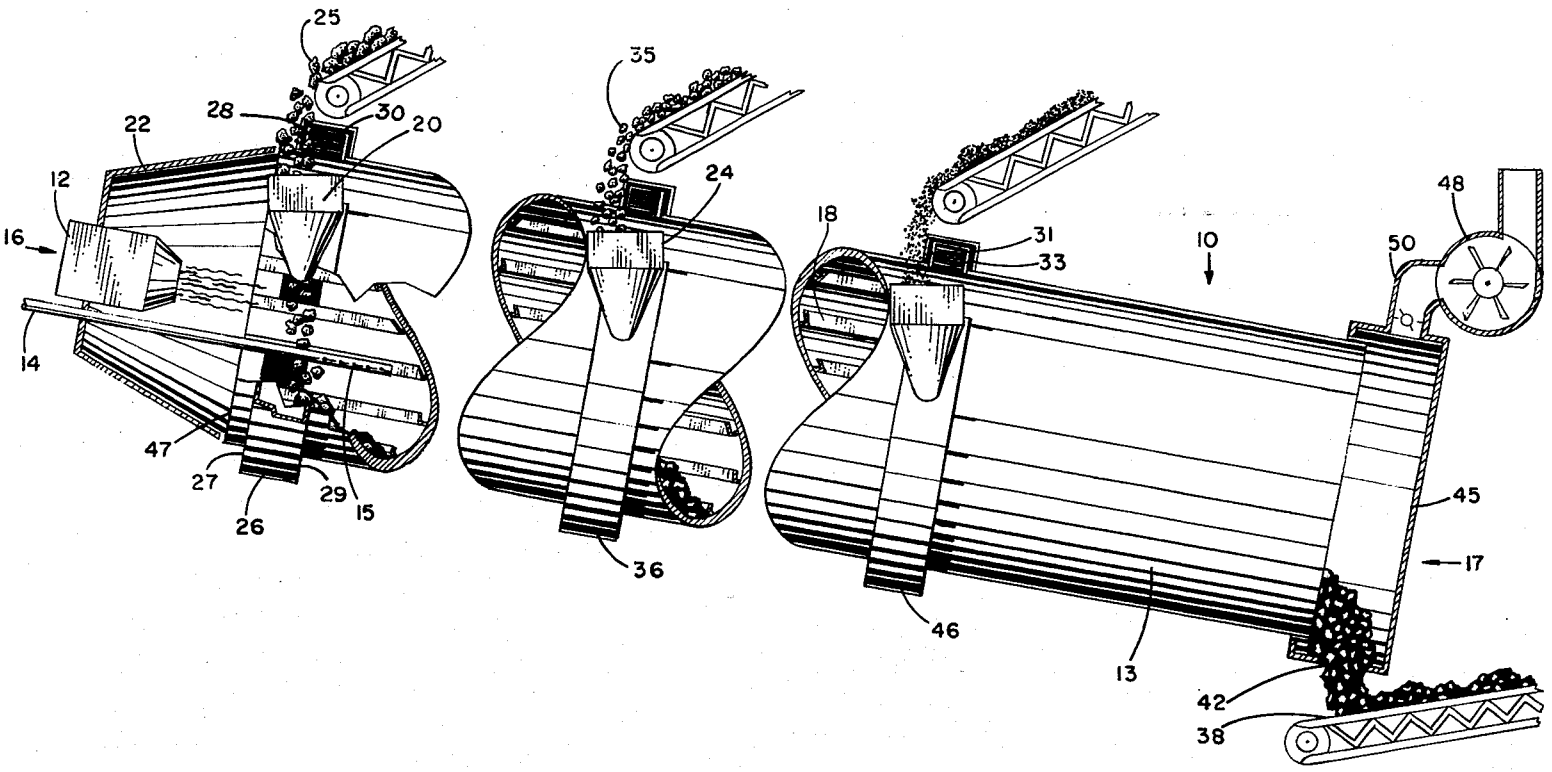
FIG. 1 illustrates the apparatus of the invention, partially in section and partially cut away, showing the improved features of the modified apparatus.

Observing now the drawings, there is illustrated a rotatable dryer-type drum 10 having an outer cylindrical cover or surface 13 and input end wall 47, and a stationary exhaust and output end cover 45, enclosing the hollow interior drum chamber. Secured on the interior drum surface are a plurality of elongated lifters 18 extending substantially the length of the drum interior. The purpose for the lifters is to assist in mixing the composition by lifting it as the drum rotates. The composition then cascades from the rising lifters and falls gravitationally to the bottom of the rotating drum during the mixing and heating operation. Conventional mixing drums of this general type for mixing and heating asphalt-aggregate compositions are shown in U.S. Pat. Nos. 3,832,201 and 3,840,215. The drum is preferably inclined as shown so that composition introduced at input end 16 will be drawn gradually gravitationally toward output drum end 17. Thus, the input end is elevated relative to the output end. The drum includes means for rotating the drum, not shown, for example a sprocket extending around the drum surface 13 to which is secured a chain also meshing with gears and a motor or other drive means. The drum may be supported on rollers and a suitable frame. Such means for rotating and supporting the drum are not a part of the invention and will be understood by those skilled in the art.

Composition introduced into the drum during the processing is heated by hot gases of combustion from burner 12, of any suitable conventional oil or gas burning type, which will produce flame and hot gases directed into the drum interior through an orifice or opening suitably located in the input end wall 47. The burner will be stationary, and may be mounted in the back cover 22, also stationary and through which is secured pipe 14 for supplying makeup asphalt to the drum interior. It may be desirable to incorporate a burner shield or baffle (not shown) against which the flame projecting from burner 12 is driven so as to better disperse the extremely hot gas of combustion around the plate. The hot gases are drawn into the drum interior to provide the heat for gradually heating the mixing composition.

The forward and opposite output drum end is covered with stationary exhaust cover 45, having a port 42 at the bottom thereof which heated and mixed composition is recovered. The composition simply falls through the port onto a conveyor 38. Other equivalent product recovery means may be used and that shown is by way of example only. Thus, the output drum end has no end wall but is open with the exhaust cover overlying the otherwise open end. Again, the cover remains stationary as the drum rotates and composition gravitationally advances, also assisted by the lifters into the exhaust cover bottom and out the port. The cover is separated at least slightly from the drum end surface to avoid interference with drum rotation. On or near the top of the exhaust cover is a gas vent stack 50 which cooperates with an exhaust fan 48 to draw the hot gases from burner 12 through the drum and into the stack for venting and discharge into the atmosphere.

The significant improvement of the process and apparatus of the present invention is the manner in which used asphalt-aggregate composition is introduced into the heating and mixing drum and the improved and advantageous result therefrom. It has been found that by introducing the smaller particles in a cooler zone in the apparatus as compared to the zone in which the larger particles are introduced, the asphalt degradation is substantially decreased, if not eliminated, and improved product is achieved, and air pollution problems due to smoke, unburned hydrocarbons, noxious gases, and fumes being vented into the atmosphere are obviated. Specifically, when used asphalt-aggregate pavements are crushed to yield compositions to be treated in a recycling process a range of particle sizes are obtained between coarse and fine. Specific particle size ranges and ratios of coarse to fine particles will depend on the type of surface the composition is obtained from. For example, parking lot and driveway surfaces often incorporate finer aggregate as compared to heavily trafficked highways, so that large particles achieved from crushing the former may be in about ½ inch while those from the latter are about 1½ inches. However, particles commonly obtained from city streets are composed of coarse particles nominally ¼ inch and larger, i.e., will not pass through a ¼ inch sieve opening, and smaller fine particles. It has also been found that the fine particles normally have a much higher asphalt content by weight than the coarse particles. Obviously, since it is desirous to retain as much of the raw materials in the used composition as possible for producing recycled product, the fines or fine particles are not to be discarded.

In the apparatus as shown, hot gases of combustion produced by burner 12 are directed into the drum interior. Although it is desirable to maximize heat utilization in heating the composition, it is also important to avoid overheating the particles as previously explained. Normally, in most hydrocarbon (oil or gas) fueled burners, a flame or luminescent or luminous portion of the rapidly oxidizing hydrocarbons is present for some distance forwardly of the burner nozzle. This visible portion or flame is extremely hot, for example, 500° to 1000° F hotter than the hot gases of combustion which are just ahead of the flame. It has been found that the larger composition particles are greater "sinks" for absorbing heat without asphalt burning whereas smaller particles may be overheated if exposed to the same temperatures for a like period of time. Accordingly, it is advantageous to introduce the coarse particles into the drum at the input end as shown so that the particles will be exposed to and pass through the hottest gases entering the drum at the input end. The finer particles are introduced some distance or distances away from the input end, in one or more zones having a temperature less than that which would cause overheating and deterioration of the asphalt. As shown in FIG. 1, coarse particles 25 are directed into drum 10 at the input end 16 just inside end wall 47, being directly exposed to gases from burner 12 in a first and hottest drum zone. This zone of the drum may have temperature of, for example, between about 1,000° and about 2,000° F, and higher, depending on the size and output of the burner as well as the dispersion of flame and hot gases. Again, if the coarse particles are of sufficient size, they may pass through the very hot flame without becoming overheated. On the other hand, if the coarse particles are not so large as to be able to withstand exposure to the flame, a baffle plate or similar flame reducer may be used.

As also shown, intermediate size particles 35 are introduced at some distance forwardly, downstream or toward the output end of the apparatus from the input end, in a second and cooler zone, while even finer particles are introduced in a third zone, even further forward from the first and second zones and cooler than either. The specific temperatures of the cooler zones will depend on the distance from the hot input end at which the finer particles are introduced as well as the output or capacity of the burner used in the apparatus. Normally, to prevent coking or burning of the finer particles passing into the drum interior, suitable temperatures will be less than about 800° F and preferably less than about 600° F. Accordingly, the finer particles are introduced at the cooler temperature or temperatures, the hot gas temperature in a specific zone being high enough to adequately heat the particles but low enough so as to prevent burning, coking, which will result in asphalt degradation, poorer product characteristics, and loss of significant amounts of volatile hydrocarbon and the like into the atmosphere in the form of smoke and undesirable fumes.

In the specific embodiment shown, with three zones being used, intermediate sized particles are introduced into the second zone and fine particles into the third zone. It will be understood that any number of a plurality of zones or positions at which composition is introduced may be used, depending on the practical considerations of apparatus design and separation and handling of different particle sizes desired. Thus, two zones may be sufficient, one hot for coarse particles and one cooler for finer particles although three zones as shown and previously described are preferred for recycling most road or street grade asphalt-aggregate compositions. Yet, for some materials even four or more zones may be desirable. Moreover, if the apparatus provided with means for introducing composition into more than two zones, only two zones need actually be used. Because of the specific distance between zones is dependent on burner capacity, particle sizes, and the like, FIG. 1 shows the drum zones segmented since actual distances may vary between different apparatus.

As previously explained, if street or road grade composition is separated into two particle size ranges, the coarse grade may be particles nominally ¼ inch and larger with fines being smaller. For most such compositions, the ratio of those grades will be between about 1:2 and about 2:1, and often about 1:1, respectively, by weight. Where three zones and grades are to be used according to the preferred embodiment, a convenient size breakdown for most street and road asphalt-aggregate compositions is coarse particles of nominal ½ inch and over, intermediate of sizes larger than a No. 8 U.S. series mesh screen and up to about 178 inch sieve opening, and fine particles smaller than the intermediate, i.e., No. 8 U.S. series mesh and smaller (larger mesh numbers). However, since these size ranges may not conveniently or practically apply to all asphalt concrete or asphalt-aggregate surfacing compositions to be recycled, particle size ranges based on weight proportions of the composition are more practical. Accordingly, in the three grade embodiment, coarse particles will comprise 40% ± 15% of the composition by weight, intermediate particles 30% ± 15% and fine particles 30% ± 15%. Such a definition may be applied universally for these recycled compositions, regardless of specific particle size ranges and is also convenient and practical in providing rather even distribution of the grades introduced into the three different drum zones. Similarly, where only two grades are used, a useful designation of coarse materials is 60% ± 20% by weight of the total composition and comprising the largest particles and fine particles being the smallest particles and 40% ± 20% by weight.

Although the particles of used asphalt-aggregate composition may be introduced in the respective zones as previously described in any suitable manner, for example, a chute or hopper, a preferred embodiment utilizes a scoop means secured to the drum exterior and cooperating with a trough into which composition is placed as is illustrated in FIG. 1. As shown, a trough 26 having sides 27 and 29 is stationarily positioned around the cylindrical drum 10 adjacent input end wall 47. A plurality of spaced ports 30 are located around the drum surface which ports open into the drum interior and communicate exteriorly thereof. A scoop 28 is secured to the drum exterior overlying each port 30, the scoops having a cavity which communicates with the port and an edge providing a surface for engaging composition as the drum rotates. Trough 26 extends around the drum covering the scoops and forming a cavity in which the scoops are disposed and pass as the drum rotates. A chute 20 communicates with trough 26 so that composition particles introduced through the chute and into the trough are then picked up by the scoops and fall gravitationally through ports 30 into the drum interior. The size and shape of the trough should be such as to allow scoops to pass without resistance therethrough and to pick up the composition introduced into the trough cavity. The trough sides will preferably have edges which follow the general shape of the drum exterior around which they extend but which side edges are spaced at least slightly from the drum surface to avoid contact since the drum rotates while the trough is maintained in a stationary position. Means for introducing composition into the trough, for example, via chute 20, is not especially critical and any convenient means may be used. For example, a conveyor system as shown may bring composition up to chute 20 and which then passes into the hopper and trough.

The size and shape of the scoops and trough are not particularly critical but are preferably such that the outer edge along the scoops are of the same shape but slightly smaller than the interior wall of the trough. The scoops are also preferably sloped so that composition will fall easily along the scoop interior and into the ports gravitationally.

Spaced forwardly from trough 26 is a substantially identical trough 36 overlying a plurality of ports and scoops like those previously described. Chute 24 communicates with the interior of trough 36 so that composition directed therein is picked up by the scoops and falls gravitationally into the drum. Trough 36 will be spaced forwardly from trough 26 so that the ports underlying the former trough will communicate with the drum exterior at a second zone which is cooler than the previously described and hottest zone adjacent the input drum end. A third trough 46 is spaced forwardly from trough 36, also having scoops 31 and ports 33 substantially like those previously described. The drum zone into which particles are introduced by this trough and cooperating scoops and ports is cooler than the second zone being even further from the burner. Thus, coarse particles are introduced into the hottest drum zone via trough 26 and the scoops and ports cooperating therewith, intermediate sized particles are introduced through second chute 24, cooperating trough 36 and underlying ports and fine particles introduced via trough 46 and its underlying scoops and ports. Otherwise, the troughs, scoops and ports are the same, the only difference being their location along the drum to avoid overheating the finer particles introduced into the heated drum cavity. Again, second and third troughs 36 and 46 are also stationary and do not rotate with the drum. As previously mentioned, in using the apparatus shown for some compositions, it may be desirable to use only two of the zones. For example, where the composition comprises smaller particles, it may be beneficial to use only the cooler second and third zones whereas for more coarse compositions, first and second or first and third zones may be useful. More specific details of the scoops, ports and troughs may be found in applicant's co-pending application Ser. No. 601,177, filed Aug. 1, 1975, which description is incorporated herein by reference.

As previously mentioned, the apparatus may incorporate one or more pipes 14 having a plurality of openings 15 or similar means for directing asphalt into the drum. In recycling the used asphalt-aggregate composition, a certain amount of make-up asphalt is necessary to replenish the product. The specific amount of make-up asphalt added may be determined by techniques appreciated by those skilled in the art, depending on the use specifications required, penetration characteristics, and the like. The asphalt is preferably added hot so that it can readily be delivered through such a pipe where it is sprayed on the particles being mixed in the drum.

Figure 2:
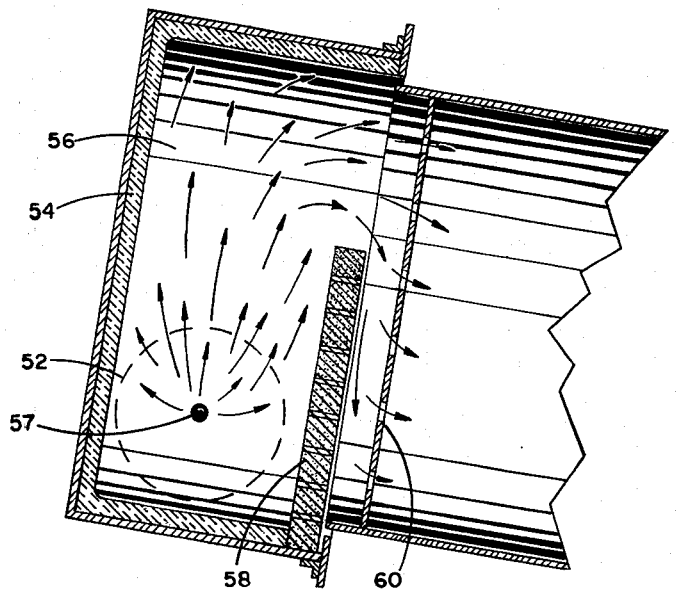
FIG. 2 is a side view partially in section showing a modified combustion chamber and burner embodiment of the invention.
Figure 3:
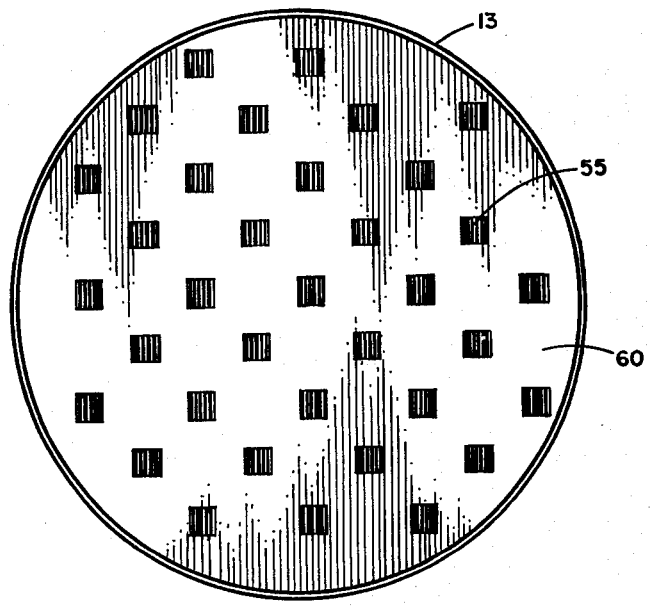
FIG. 3 is a view showing a diffusion plate used in the embodiment of FIG. 2.

FIGS. 2 and 3 illustrate another improvement of the apparatus and its use in beneficially heating, but not overheating compositions treated according to the invention. FIG. 2 show a side sectional view of end of drum 10 into which hot gases of combustion are introduced. As previously explained, for many compositions, it may be important to avoid contact of the coarse recycled particles with the flame from the burner because of its extreme heat. Yet this may be problematic using a burner directing flame toward the drum as shown in FIG. 1, even with a baffle plate, since often the flame may not be entirely confined. In the improved embodiment of FIG. 2, burner 52 (shown in phantom) is positioned so that nozzle 57 projects flame normal to be axis of drum 10 within combustion chamber 56 defined interiorly of cover 54. Along the drum end of the combustion chamber is a thermal barrier plate 58, extending across the combustion chamber between its sides and from its bottom surface and being high enough above the burner nozzle elevation to substantially prevent flame from projecting past the plate. Thus, the flame is confined to the combustion chamber. The barrier plate may be any suitable composition capable of withstanding the extreme heat to which it is exposed, such as stainless steel, fire brick and the like.

Spaced from barrier plate 58 is a diffuser plate 60, having a plurality of orifices 55 and which plate forms the end wall of drum 10. The purpose of the diffuser plate is to evenly distribute the hot gases of combustion from the burner and combustion chamber into the drum interior. Since there is a substantial draft created in the drum due to the exhaust fan pulling gases from the hot end to the output end as previously described, the hot gases will be drawn from the combustion chamber, over barrier plate 58 and distributed through the diffuser orifices into the drum as illustrated by the arrows. The orifices 55 will be of sufficient number, location and size as to provide maximum distribution thereby preventing larger gas volumes to be drawn through one area of the plate than others. Space 51 between barrier plate 58 and diffuser plate 60 will also be sufficient so as not to restrict or retard adequate flow and even distribution of the gas. Other modifications to the apparatus as well as advantages thereof within the purview of the invention will be evident to those skilled in the art.

I claim:

1. A process for recycling used asphalt-aggregate compositions comprising:

a. Crushing said used composition;
b. separating said crushed composition into coarse particles and fine particles having a ratio of between about 2:1 and 1:2 by weights, respectively;
c. introducing said coarse particles in a hot zone of a rotatable drum and gradually advancing said particles toward an output drum end;
d. introducing said fine particles in said drum downstream from said hot zone in a cooler temperature zone; and
e. gradually mixing and heating said coarse and fine particles as said composition is drawn to said drum output end.

2. The process of claim 1 including the step of adding make-up asphalt in said drum while mixing and heating said particles.

3. In a process for heating and mixing particles of asphalt-aggregate composition in a rotating drum into which hot gases of combustion are directed for said heating while gradually drawing said composition from an input drum end to an output end, the improvement comprising separating said particles into a plurality of different particle sizes ranging from coarse to fine, introducing coarse particles at said drum input end, said coarse particles being exposed to said gases in a hot temperature zone, and introducing smaller sized particles of said composition in said drum in one or more cooler temperature zones, the temperature of said cooler zones being below that which would burn the asphalt of said particles.

4. The process of claim 3 wherein the temperature in said hot zone is at least about 1000° F.

5. The process of claim 4 wherein the temperature in said cooler zone is below about 800° F.

6. The process of claim 5 wherein said particles are separated into three particle size ranges comprising between about 25% and about 55% by weight coarse particles, between about 15% and about 45% by weight intermediate particles and between 15% and about 45% by weight fine particles, said intermediate and fine particles each being introduced in separate and cooler zones, respectively.

7. The process of claim 3 wherein the temperature in said cooler zones is below about 800° F.

8. The process of claim 3 wherein said particles are separated into three particle size ranges comprising between about 25% and about 55% by weight coarse particles, between about 15% and about 45% by weight intermediate particles and between 15% and about 45% by weight fine particles, said intermediate and fine particles each being introduced in separate and cooler zones, respectively.

9. The process of claim 8 wherein said coarse particle size is ½ inch mesh and larger, said intermediate sizes are between a No. 8 U.S. series and ½ inch mesh, and said fine sizes are No. 8 U.S. series mesh and smaller.

10. An apparatus for treating asphalt-aggregate composition comprising:
a. an elongated mixing drum and means for rotating said drum;
b. means for supplying hot gases of combustion at an input end of said drum;
c. means for introducing coarse composition particles into said drum in a hot zone at said input end whereby said composition is directly exposed to said hot gases;
d. means for introducing fine composition particles into said drum in a cooler zone spaced from said input end; and
e. means for recovering said heated and mixed composition at an output end of said drum.

11. Apparatus of claim 10 wherein at least one of said means for introducing composition comprises a plurality of scoops spaced around said drum a port communicating with each scoop and interiorly of said drum, and a stationary trough extending around at least the lower portion of said drum for receiving said composition and said scoops as said drum rotated.

12. Apparatus of claim 11 including a combustion chamber adjacent said input drum end, a hydrocarbon burner having a nozzle for directing flame and gases of combustion into said chamber, a flame barrier plate extending partially across said chamber between said burner and said drum, and a heat diffusing plate between said barrier and the interior of said drum having a plurality of orifices through which gases of combustion are evenly distributed into said drum.

13. Apparatus of claim 10 wherein said mixing means comprises a plurality of lifters along the drum interior.

14. Apparatus of claim 10 including means for introducing make-up asphalt in said drum.

15. Apparatus of claim 10 including a combustion chamber adjacent said input drum end, a hydrocarbon burner having a nozzle for directing flame and gases of combustion into said chamber, a flame barrier plate extending partially across said chamber between said burner and said drum, and a heat diffusing plate between said barrier and the interior of said drum having a plurality of orifices through which gases of combustion are evenly distributed into said drum.

* * * * *